US006230933B1

(12) United States Patent
Wysoczynski

(10) Patent No.: US 6,230,933 B1
(45) Date of Patent: May 15, 2001

(54) PRE-PACKAGED ROLLABLE ARTICLES

(76) Inventor: Donald T. Wysoczynski, 109 Wilson Cir., Carrollton, GA (US) 30117

( * ) Notice: Subject to any disclaimer, the term of this patent is extended or adjusted under 35 U.S.C. 154(b) by 0 days.

(21) Appl. No.: 09/250,138

(22) Filed: Feb. 16, 1999

(51) Int. Cl.[7] ..... A47F 1/04

(52) U.S. Cl. ..... 221/305; 206/427

(58) Field of Search ..... 221/194, 303, 221/305, 289; 206/427

(56) References Cited

U.S. PATENT DOCUMENTS 5,390,821 * 2/1995 Markel ..... 221/194

* cited by examiner

*Primary Examiner*—Kenneth W. Noland
(74) *Attorney, Agent, or Firm*—Herbert M. Hanegan, Esq.

(57) ABSTRACT

An insertable dispenser and method is provided for dispensing pre-packaged rollable articles directly from a package. The dispenser includes an inclined base and receiving arm to allow the articles to controllably roll out of the package and accommodate individual dispensing while preventing the articles from spilling out of the package.

16 Claims, 1 Drawing Sheet

PRE-PACKAGED ROLLABLE ARTICLES

BACKGROUND OF THE INVENTION

The present invention relates to dispensing pre-packaged rollable articles directly from the packages in which the articles are stored. In particular, the invention relates to a dispenser that is inserted into the package of stored articles to dispense the articles individually from the package.

Various types of dispensing devices and dispensing methods for rollable articles are known. Most of these devices are dispensing racks or distributing devices that are particularly well-suited to individually dispense rollable articles for both retail and personal dispensing. Examples of typical prior art racks and devices are disclosed in Washburn U.S. Pat. No. 1,753,957, Root U.S. Pat. No. 3,356,279, Deffner et al. U.S. Pat. No. 4,105,126, Eckert U.S. Pat. No. 4,228,903, Spamer et al. 4,997,094, Delaney U.S. Pat. No. 5,356,033, and Blasko et al. U.S. Pat. No. 5,228,590. In the prior dispensing racks the individual articles must be manually loaded into the racks by hand. Because most rollable articles, like beverage containers, are pre-packaged, manual unpacking in addition to manual loading must be performed prior to use of these devices. The requirement of these procedures is inefficient, time consuming, and inconvenient. In addition, the use of these devices increases the risk of damaging the articles and their contents, and also poses risks of physical injury to the individual performing the manual procedures.

In view of the foregoing, devices and methods to controllably dispense individual rollable articles directly from the packages in which they are sold have also been developed. U.S. Pat. No. 5,390,821, Markel, discloses a method and apparatus for dispensing rollable articles from a package. The device disclosed in Markel is secured over an open end of a package containing the articles, and contains a dispensing port at its base. The Markel device acts as a wall to prevent the articles from spilling out of the package, and at the same time permits individual dispensing from the dispensing port at its base. Because the device must be large enough to cover the entire end of a package, it is cumbersome and requires considerable material to manufacture. In addition, the device is vulnerable to unpredicted movement of the articles such that articles may become jammed near the port, or may not roll forward into the dispensing port without manual assistance to tip the package forward.

As a result, the need exists for a device that controllably dispenses pre-packaged rollable articles which is easy to use and cost-effective to manufacture, as well as capable of creating predicted rolling and dispensing of the articles from the package. The present invention relates to a device for dispensing pre-packaged rollable articles by utilizing an inclined base that is inserted directly into the rollable article package and containing a receiving arm of sufficient height that allows for controllably dispensing the articles individually from an open end of the package. In particular, the present invention is very well-suited to dispense 12 ounce beverage container cans pre-packaged in standard twelve and twenty-four count packages.

SUMMARY OF THE INVENTION

Among the several objects of the invention is the provision of a dispensing device and method for use with pre-packaged rollable articles;

A further object is the provision of a dispensing device having an inclined base that is inserted directly into a package of rollable articles to predictably control movement of the articles as the articles are dispensed from the package;

The provision of such device and method allows individual pre-packaged rollable articles to be automatically and controllably dispensed directly from the package in which the articles are contained.

In accordance with the invention, generally stated, an insertable dispenser is used to controllably dispense pre-packaged rollable articles from a package. The dispenser has an inclined base with a receiving arm. The inclined base is inserted into the open end of the package between the packaged rollable articles and a package wall. The portion of the base with elevation means is positioned opposite the open end of the package, slightly lifting the packaged articles on an incline. Gravity causes the articles to roll forward and down the incline. When inserted, a receiving arm which is fixedly connected to the inclined base protrudes out the open end of the package. The rolling articles are received individually and in abutting relationship to the receiving arm. The receiving arm holds the article in place, as well as prevents the other packaged articles from rolling forward until the article in the receiving arm is removed. When the article in the receiving arm is removed the incline causes another article to automatically roll to and abut the receiving arm. Other objects and features will be apparent from the following description.

DESCRIPTION OF PREFERRED EMBODIMENTS

Figure 1:
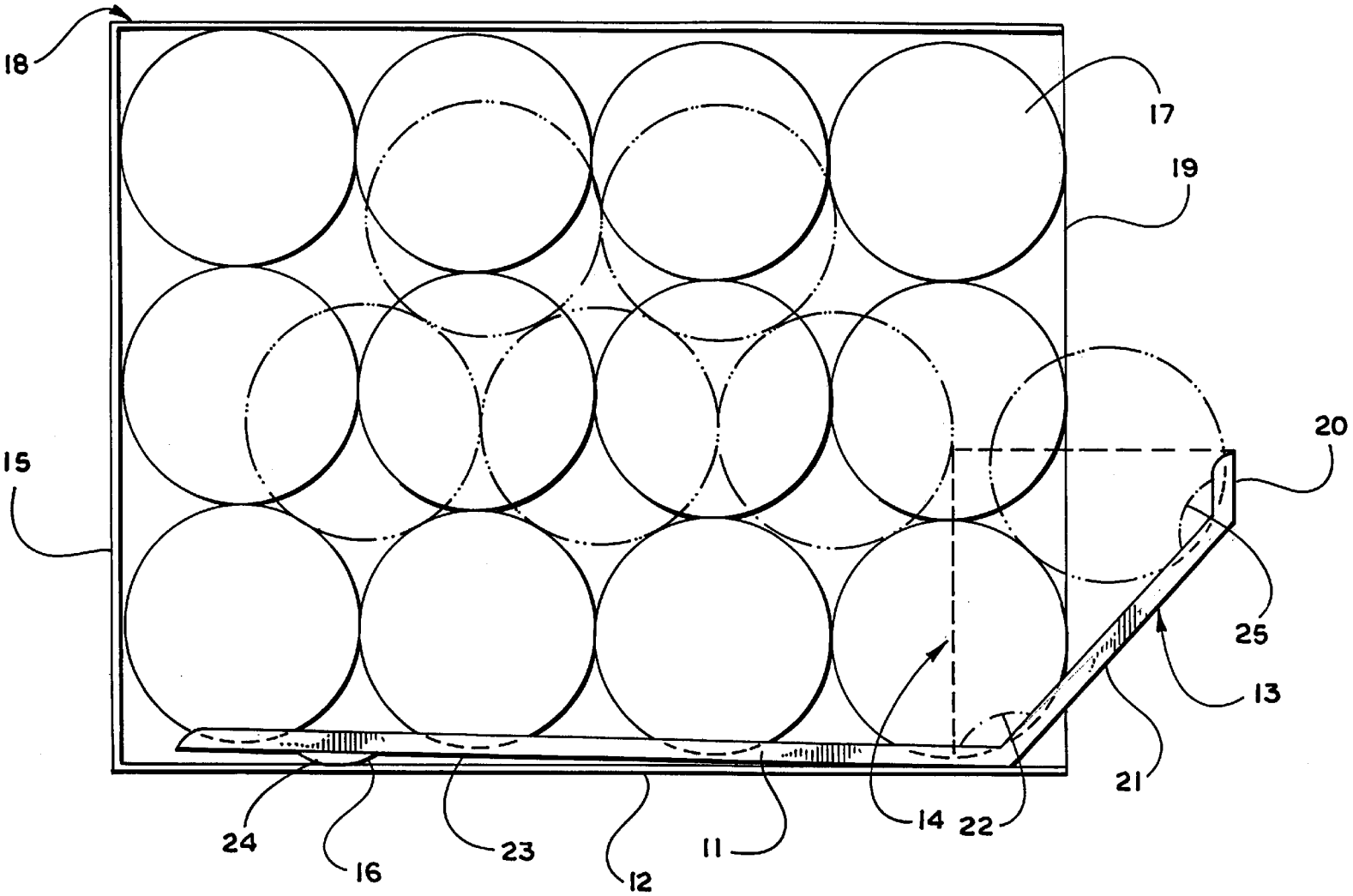
FIG. 1 is a cross-sectional view showing the insertable dispenser of the present invention inserted into a package of pre-packaged rollable beverage containers.

FIG. 1 illustrates the insertable dispenser 11 of the present invention for dispensing pre-packaged uniformly-sized cylindrically-shaped beverage containers 17 from a generally rectangularly-shaped package 18. The containers 17 are generally twelve ounce size.

The generally rectangularly-shaped package 18 contains a plurality of the pre-packaged containers 17 and is typically formed of cardboard material. The containers 17 are generally packaged side-by-side in the package such that the containers are arranged vertically and horizontally in rows. The number of pre-packaged containers 17 advantageously is either twelve count or twenty-four count. Once the package 18 is opened at end 19 the package is ready for the insertable dispenser 11 to be inserted into the package 18 beneath the plurality of pre-packaged containers 17. Typically the package 18 will be opened in a vertical orientation with end 19, with the end material partially or completely removed, oriented at the top of the package to prevent containers 17 from spilling uncontrollably out of the package 18. The insertable dispenser 11 is then inserted in the at least partially open end 19 between an adjacent bottom side of the package 12 and the plurality of containers 17. The package/dispenser combination is placed in a horizontal position for use.

Dispenser 11 is provided with a receiving arm 13 for receiving the containers 17 individually at the open end 19 of the package. The receiving arm includes a diagonal portion 21 which, in one optional embodiment, connects optional vertical terminating edge 20 to inclined base portion 23. The optional terminating edge 20 forms an angle 25 of greater than about 90°, advantageously from about 110° to about 145° with the diagonal portion of the receiving arm 13. Preferably angle 25 is from about 120° to about 135°.

As illustrated, dispenser 11 is provided with inclined base 23 that is connected to the receiving arm 13 at an angle 22 approximately equal to angle 25, i.e. greater than about 90°, advantageously from about 110° to about 145° and preferably from about 120° to about 135°. The width of the inclined base advantageously is from about 0.7 to about 1.2 times the length of a container and preferably is approximately equal to the length of a container 17 to control the movement of the containers 17. In addition, the height of the receiving arm 13 from the inclined base 23 is advantageously from about 1.2 to about 1.6, preferably from about 1.3 to about 1.4, times the diameter of container 17, as shown by broken lines 14. The inclined base 23 extends into the package 18 from the open end 19 along the bottom side of the package 12 to the opposite end 15 of package 18. The bottom of inclined base 23 near opposite end 15 of package 18 is elevated by at least one support advantageously rounded, or the equivalent thereof, to create an incline running forwardly and downwardly from the opposite end 15 of the package 18 to the open end 19. Advantageously the inclined base has a right support 24 and a left support 16.

After the dispenser 11 is inserted, the incline gravitationally causes the plurality of containers 17 to roll forwardly and downwardly toward the open end 19 of the package 18 and against the receiving arm 13. The rolling motion of a container 17 forces it against the receiving arm 13. The diagonal portion of the receiving arm 21 and, when present, the terminating edge 20, receive the container 17 and hold it in place. When a container is removed, another of the containers 17 will be dispensed from the package against the receiving arm 13. When a single row of containers 17 remains in the package 18, the containers 17 will be dispensed at the receiving arm 13 where angle 22 is formed with the inclined base 23.

In view of the foregoing, those skilled in the relevant art will appreciate that the present invention is capable of being expressed in many embodiments, all of which are capable of being inserted into an open end of a package of pre-packaged rollable articles, creating an incline to dispense the articles such that an article dispensed from the package is received in a receiving arm of the dispenser, and allowing an individual to easily remove a rollable article from the receiving arm.

Thus, it will be appreciated that the present invention provides a novel method of dispensing pre-packaged rollable articles 17 from a package 18. The method includes inserting an insertable dispenser 11 into the open end 19 of the package 18 beneath the articles 17. The dispenser 11 comprises an inclined base 23, which provides the force for a single container 17 to roll and abut the receiving arm 13 when the package 18 is placed horizontally on a surface. Thus an individual container 17 held against the receiving arm 13 may be retrieved from the receiving arm 13 without the other containers flowing out of the package 18.

The foregoing detailed description of the invention has been made with reference to preferred embodiments thereof. From this description one skilled in the art can easily ascertain the essential characteristics of this invention, and could make changes or modifications to adapt for various usages and conditions. For example, the rounded supports on the inclined base could be replaced by solid strips or a flat mass to create the incline that causes the containers to roll forward out of the package.

What is claimed is:

1. An insertable dispenser which controls the dispensing of pre-packaged uniformly-sized rollable articles from an open end of a package, said dispenser comprising:

a receiving arm for receiving the articles to be dispensed from an open end of the package; and an inclined base fixedly connected to the receiving arm for insertion into the package beneath the rollable articles, whereby said inclined base gravitationally dispenses the rollable articles downwardly and forwardly towards the open end of the package into abutting relationship with the receiving arm, wherein the inclined base has a width of from about 0.7 to about 1.2 times the length of a rollable article contained in the package.

2. The insertable dispenser of claim 1 wherein the inclined base has a width about equal to the length of a rollable article contained in the package.

3. The insertable dispenser as set forth in claim 1, wherein the receiving arm extends diagonally upwardly and away from the inclined base at an angle greater than about 90°.

4. The insertable dispenser as set forth in claim 3 wherein said receiving arm terminates in a vertical edge that forms an angle greater than about 90° with the diagonal portion of the receiving arm.

5. The insertable dispenser as set forth in claim 3, wherein the receiving arm extends diagonally upwardly and away from the inclined base at an angle of from about 110° to about 145°.

6. The insertable dispenser as set forth in claim 5, wherein said receiving arm terminates in a vertical edge that forms an angle of from about 110° to about 145° with the diagonal portion of the receiving arm.

7. The insertable dispenser as set forth in claim 5, wherein the receiving arm extends diagonally upwardly and away from the inclined base at an angle of from about 120° to about 135°.

8. The insertable dispenser as set forth in claim 7, wherein said receiving arm terminates in a vertical edge that forms an angle of from about 120° to about 135° with the diagonal portion of the receiving arm.

9. The dispenser of claim 1 wherein the height of the receiving arm measured from the inclined base is from about 1.2 to about 1.6 times the diameter of the rollable article.

10. The dispenser of claim 9 wherein the height of the receiving arm measured from the inclined base is from about 1.3 to about 1.4 times the diameter of the rollable article.

11. The insertable dispenser as set forth in claim 2, wherein the inclined base is connected to the receiving arm at the open end of the package, said inclined base extending back into the package, said inclined base further comprising:

elevation means attached to the bottom of the inclined base near the end of the inclined base opposite the open end of the package.

12. The insertable dispenser as set forth in claim 2, wherein the rollable articles are cylindrically-shaped twelve ounce beverage containers, the package is generally rectangular-shaped, and wherein the containers are stored side-by-side in the package such that the containers are arranged vertically and horizontally in rows.

13. The insertable dispenser as set forth in claim 1, wherein the inclined base is connected to the receiving arm at the open end of the package, said inclined base extending back into the package, said inclined base further comprising:

elevation means attached to the bottom of the inclined base near the end of the inclined base opposite the open end of the package.

14. The insertable dispenser as set forth in claim 13, wherein:

the rollable articles are cylindrically-shaped twelve ounce beverage containers, the package is generally rectangular-shaped, the containers are stored side-by-side in the package such that the containers are arranged vertically and horizontally in rows; and wherein the inclined base is connected to the receiving arm at the open end of the package, said inclined base extending back into the package, said inclined base further comprising:

elevation means attached to the bottom of the inclined base near the end of the inclined base opposite the open end of the package.

15. The insertable dispenser of claim 8 wherein the elevation means is at least one support having a rounded surface facing away from the bottom of the inclined base.

16. The insertable dispenser of claim 8 wherein the elevation means is at least one support having a flat surface facing away from the bottom of the inclined base.

* * * * *